US005921345A

United States Patent [19]

Cheng

[11] Patent Number: 5,921,345

[45] Date of Patent: Jul. 13, 1999

[54] SAFETY HARNESS

[75] Inventor: Den Shan Cheng, Kaohsiung, Taiwan

[73] Assignee: Tungsafe Corporation, Kaohsiung, Taiwan

[21] Appl. No.: 09/061,008

[22] Filed: Apr. 15, 1998

[51] Int. Cl.[6] ..... A47L 3/04

[52] U.S. Cl. ..... 182/7; 182/3; 182/6

[58] Field of Search ..... 119/770, 857, 119/907; 24/573.5; 54/28, 50, 54; 244/151 R, 151 A, 151 B, 142; 472/118; 466/49; 182/3, 7, 6, 4, 55, 142; 304/16; 224/159

[56] References Cited

U.S. PATENT DOCUMENTS

| | | | |
|---|---|---|---|
| 1,109,065 | 9/1914 | Heath et al. | 224/159 |
| 2,468,588 | 4/1949 | Clemens, Jr. | 224/159 |
| 3,448,826 | 6/1969 | Rosenblum | 182/3 |
| 5,080,191 | 1/1992 | Sanchez | 182/3 |
| 5,131,490 | 7/1992 | Bell | 182/7 |

*Primary Examiner*—Robert P. Swiatek
*Assistant Examiner*—Son T. Nguyen
*Attorney, Agent, or Firm*—Pro-Techtor International Services

[57] ABSTRACT

A safety harness includes an endless main belt hung on a suspension cable, a saddle fastened to the endless main belt at a bottom side remote from the suspension cable, a stretcher transversely fastened to two parallel sections of the endless main belt and vertically spaced between the suspension cable and the saddle to impart a space within the endless main belt for movement of the user's head, two supplementary belts fastened to the main belt and defining with it three vertically spaced pairs of insertion holes, a chest strap and a waist strap and two thigh straps respectively inserted through the insertion holes and fastened to the user's chest, waist and thighs by respective buckles for securing the user to the saddle.

2 Claims, 5 Drawing Sheets

SAFETY HARNESS

BACKGROUND OF THE INVENTION

The present invention relates to a safety harness hung on a suspension cable for carrying a person, and more particularly to such a safety harness which is comfortable and safe in use.

FIG. 1 shows a safety harness for fastening to a suspension cable (or crane) for carrying a person, enabling the person to be lifted with the suspension cable to a high place to wash the outside wall of a building, to install or repair a construction work, etc. The safety harness comprises two main belts 10 arranged together, a hanging ring 20 fastened to the crossed top area 101 at the main belts 10 for hanging on a suspension cable, and a waist strap 40 fastened to the two crossed side areas 102 at the main belts 10 by stitches. The two opposite ends of the main belts 10 form two thigh straps 103. The waist strap 40 and the thigh straps 103 are equipped with a respective buckle 30 for joining the respective ends. When in use, as shown in FIG. 2, the waist strap 40 and the thigh straps 103 are respectively fastened to the user's waist and thighs, and the crossed top area 101 of the main belts 10 is hung on the user's neck. This structure of safety harness can firmly secure the user to the suspension cable. However, because the user's thighs are hung on the thigh straps 103 and the user's neck is constrained by the crossed top area 101 of the main belts 10, the user feels uncomfortable. When lifting, the user swings with the harness, the thighs may be paralyzed, and the movement of the user's head is constrained.

SUMMARY OF THE INVENTION

The present invention has been accomplished to provide a safety harness which eliminates the aforesaid drawbacks. It is one object of the present invention to provide a safety harness which is comfortable and safe in use. It is another object of the present invention to provide a safety harness which does not hinder the movement of the user's head when lifted by a suspension cable. To achieve these and other objects of the present invention, there is provided a safety harness which comprises an endless main belt hung on a suspension cable, a saddle fastened to the endless main belt at a bottom side remote from the suspension cable, a stretcher transversely fastened to the endless main belt between two parallel sections of the endless main belt and vertically spaced between the suspension cable and the saddle to impart a space within the endless main belt for movement of the user's head, two supplementary belts fastened to the main belt and defining with it three vertically spaced pairs of insertion holes, a chest strap and a waist strap and two thigh straps respectively inserted through the insertion holes and fastened to the user's chest, waist and thighs by respective buckles for securing the user to the saddle.

DETAILED DESCRIPTION OF THE PREFERRED EMBODIMENT

Figure 1:
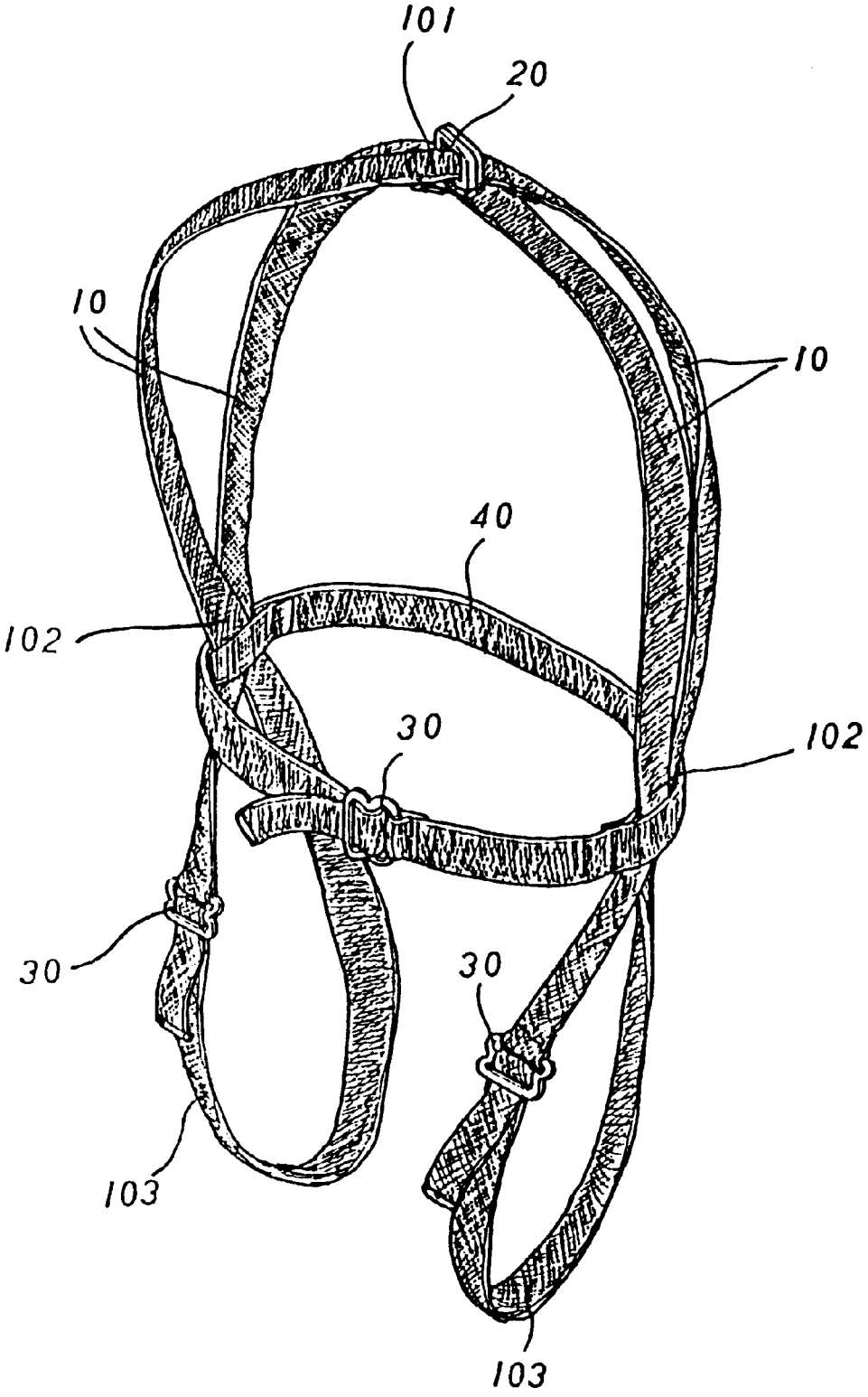
FIG. 1 (Prior Art)
FIG. 1 is a perspective view of a safety harness according to the prior art.
Figure 2:
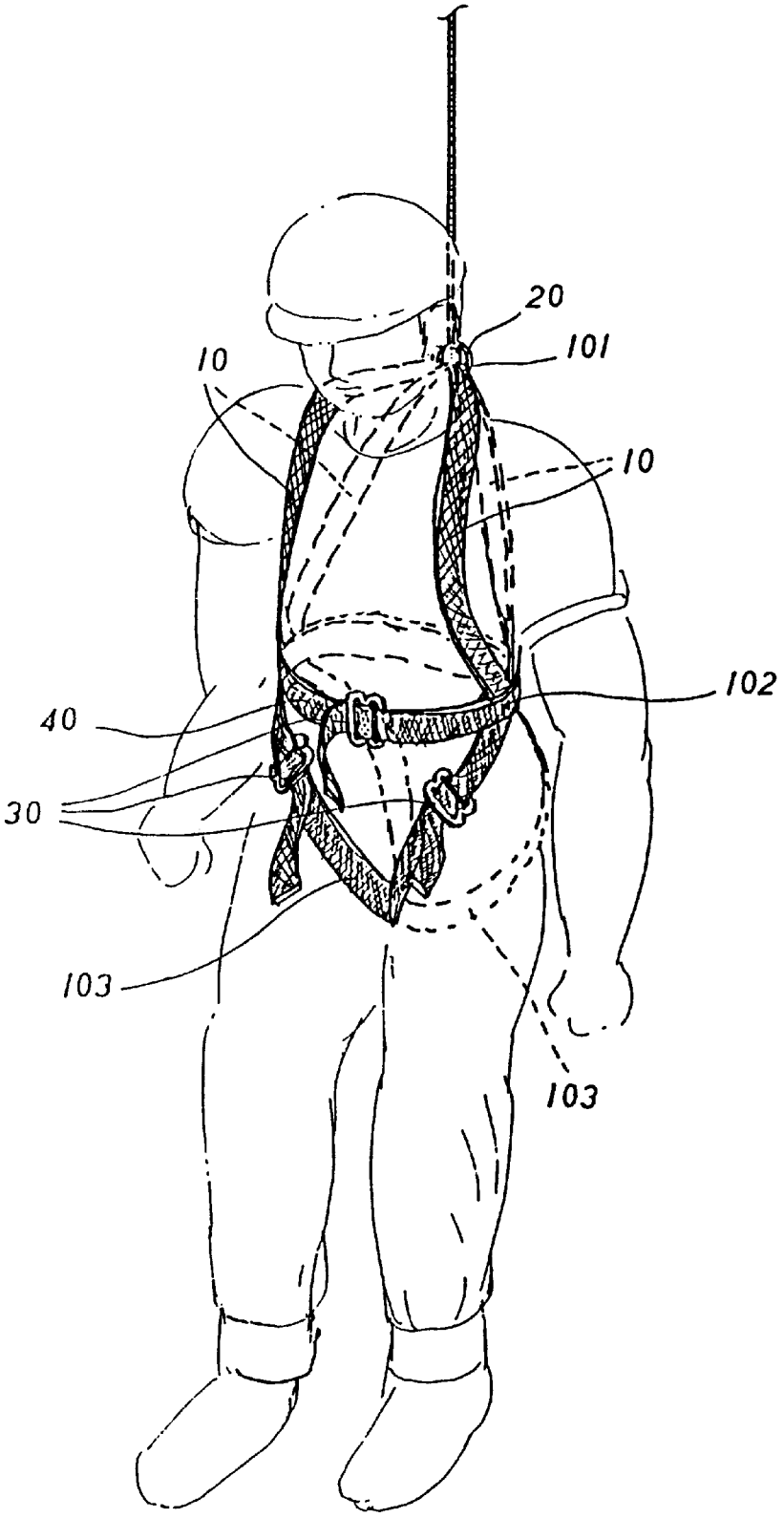
FIG.2 (Prior Art)
FIG. 2 is a schematic drawing showing the safety harness of FIG. 1 fastened to the user.
Figure 3:
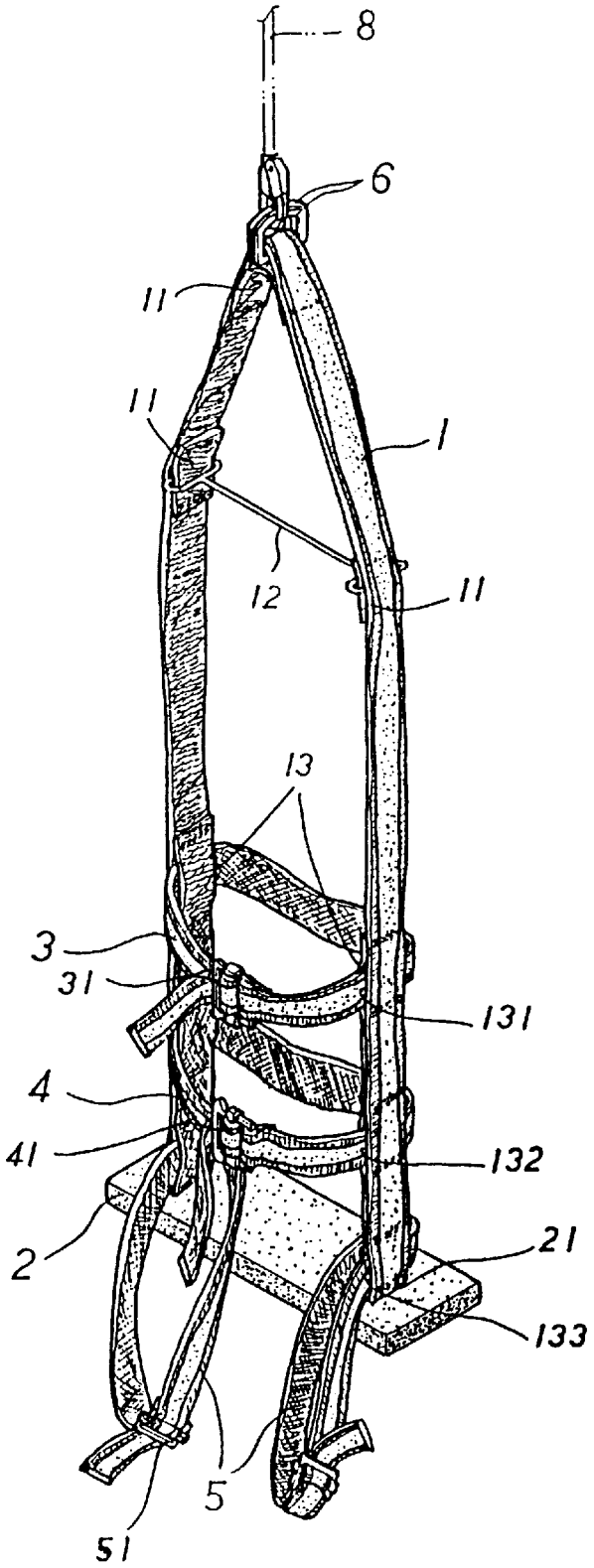
FIG. 3 is a perspective view of a safety harness according to the present invention.

Referring to FIG. 3, a safety harness in accordance with the present invention is generally comprised of a main suspender 1, a saddle 2, a chest strap 3, a waist strap 4, and two thigh straps 5.

Figure 4:
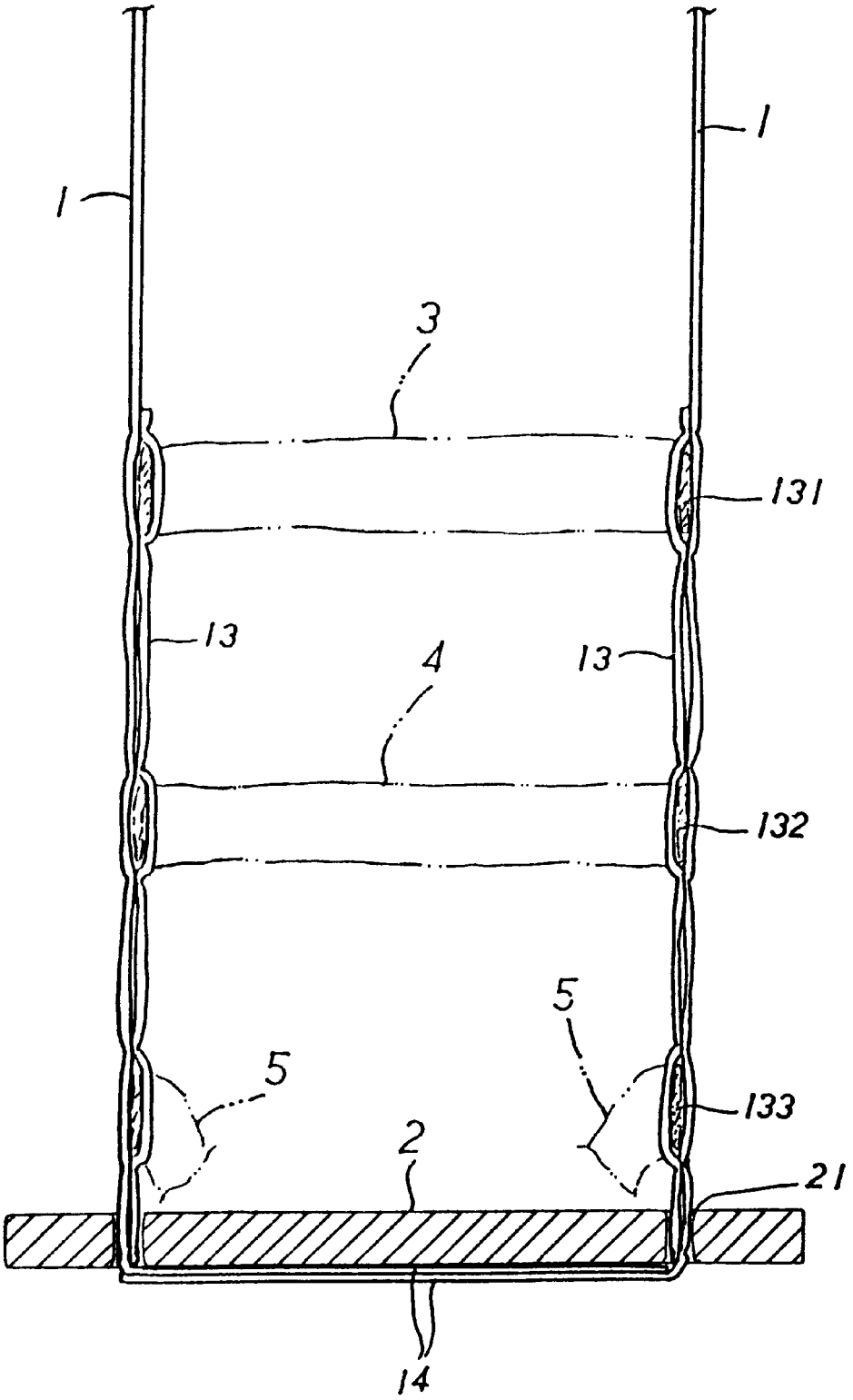
FIG. 4 is a plain view of the safety harness according to the present invention.

Referring to FIG. 4 and FIG. 3 again, the main suspender 1 comprises a main belt 11 inserted through a hanging ring 6, the main belt 11 having two opposite ends 14 respectively inserted through two through holes 21 near two ends of the saddle 2 and then fixedly stitched together at the bottom side of the saddle 2, a stretcher 12 made from a resilient metal wire rod and transversely connected between two parallel sections of the main belt 11 and spaced between the hanging ring 6 and the saddle 2, two supplementary belts 13 bilaterally fastened to the main belt 11 on the inside and defining with the main belt 11 symmetrical pairs of vertically spaced insertion holes 131;132;133 for mounting the chest strap 3, the waist strap 4 and the thigh straps 5 respectively. The saddle 2 is preferably stuffed with a sponge pad and covered with a cloth covering for sitting comfortably. The chest belt 3 is inserted through the upper pair of insertion holes 131, and equipped with a buckle 31 for joining the ends thereof. The waist strap 4 is inserted through the intermediate pair of insertion holes 132, and equipped with a buckle 41 for joining the ends thereof. The thigh straps 5 are respectively inserted through the lower pair of insertion holes 133, each equipped with a buckle 51 for joining the respective ends. Further, the main belt 11, the supplementary belts 13, the chest strap 3, the waist strap 4 and the thigh straps 5 are respectively covered with light reflecting means that reflects light when at night.

Figure 5:
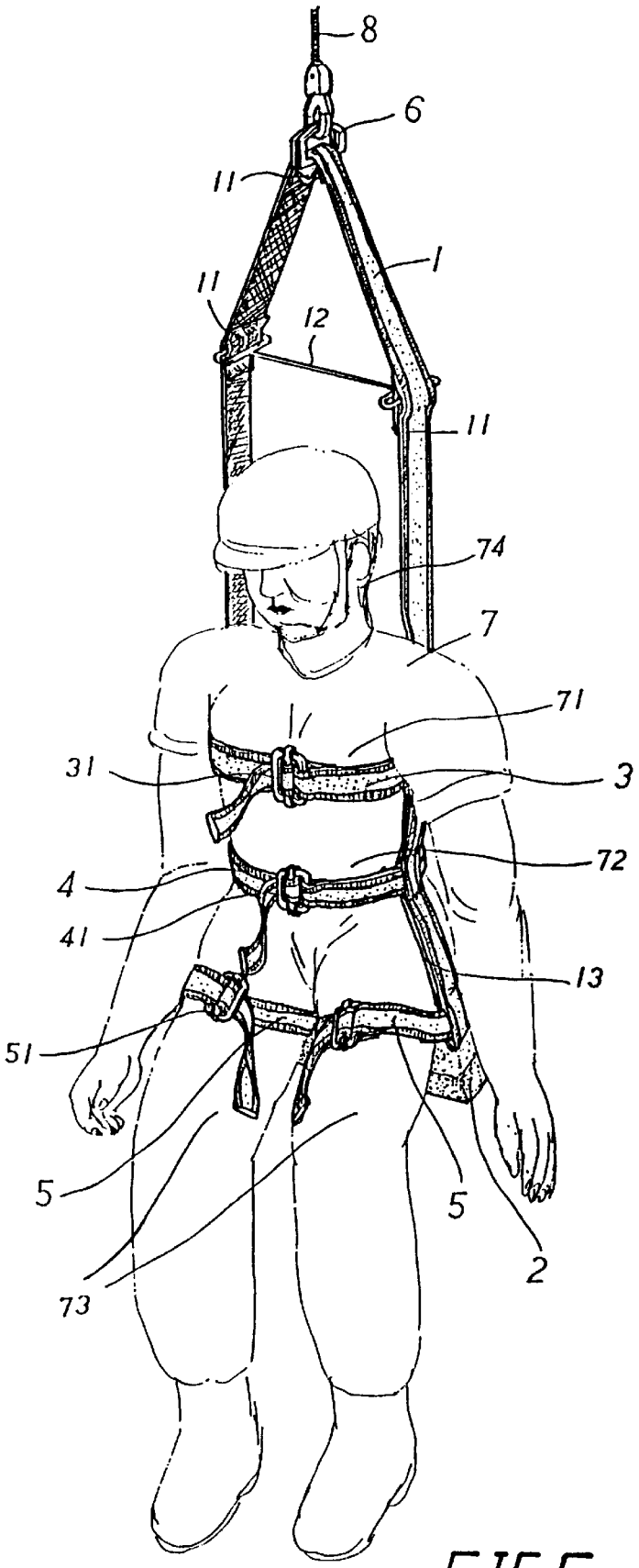
FIG. 5 is an applied view of the present invention, showing the safety harness fastened to the user.

Referring to FIG. 5, when in use, the hanging ring 6 is fastened to for example a suspension cable 8. After the user 7 sits on the saddle 2, the chest strap 3, the waist strap 4 and the tight straps 5 are respectively fastened to the user's chest 71, waist 72 and thighs 73. When the suspension cable 8 is taken up to lift the harness, the user 7 is lifted with the harness. Because the user's thighs 73, waist 72 and chest 71 are secured to the thigh straps 5, the waist strap 4 and the chest strap 3 and the center of gravity of the body of the user is located in the hip and the saddle 2, the user does not feel uncomfortable, and the circulation of blood keeps functioning well without causing the feet to be paralyzed. Furthermore, because the upper part of the main belt 11 is stretched by the stretcher 12, sufficient space is provided within the two parallel sections of the main belt 11 for movement of the user's head.

While only one embodiment of the present invention has been shown and described, it will be understood that various modifications and changes could be made thereunto without departing from the spirit and scope of the invention disclosed.

What the invention claimed is:

1. A safety harness hung on a suspension cable for carrying a person, comprising:

a saddle having two through holes near two opposite ends thereof;

a hanging ring hung on said suspension cable;

a main belt inserted through said hanging ring, said main belt having two parallel sections downwardly extended from said hanging ring, and two opposite end sections respectively extended from said parallel sections and inserted through the two through holes on said saddle from a top side of said saddle and then fixedly stitched together at a bottom side of said saddle;

a stretcher made from a resilient metal wire rod and transversely connected between two parallel sections of said main belt and spaced between said hanging ring and said saddle;

two supplementary belts bilaterally fastened to the parallel sections of said main belt at an inner side and defining with said main belt an upper pair of insertion holes, an intermediate pair of insertion holes, and a lower pair of insertion holes;

a chest belt inserted through said upper pair of insertion holes for securing to the user's chest, said chest belt being equipped with a buckle for joining ends thereof;

a waist strap inserted through said intermediate pair of insertion holes for securing to the user's waist, said waist strap being equipped with a buckle for joining ends thereof;

two thigh straps respectively inserted through said lower pair of insertion holes for securing to the user's thighs, said thigh straps each being equipped with a buckle for joining respective ends thereof.

2. The safety harness of claim 1, wherein said main belt, said supplementary belts, said chest strap, said waist strap and said thigh straps are respectively covered with light reflecting means.

* * * * *